United States Patent [19]

Perkins

[11] 4,184,830

[45] Jan. 22, 1980

[54] TROWEL FOR PIPE LINING MATERIAL

[76] Inventor: Alfred G. Perkins, 1000 Porterville Rd., East Aurora, N.Y. 14052

[21] Appl. No.: 927,854

[22] Filed: Jul. 25, 1978

[51] Int. Cl.[2] ..... B28B 7/32

[52] U.S. Cl. ..... 425/262; 118/105; 249/65; 425/95; 425/460; 425/469

[58] Field of Search ..... 425/95, 262, 460, 469; 249/65; 118/105

[56] References Cited

U.S. PATENT DOCUMENTS

| | | | |
|---|---|---|---|
| 2,987,794 | 6/1961 | Perkins | 425/262 |
| 3,074,139 | 1/1963 | Gay | 425/262 |
| 3,105,282 | 10/1963 | Perkins | 425/262 |
| 3,257,697 | 6/1966 | Ruegsegger | 425/262 |
| 3,257,698 | 6/1966 | Ruegsegger | 425/262 |
| 3,257,699 | 6/1966 | Ruegsegger | 425/262 |
| 3,334,389 | 8/1967 | Matheny | 425/262 |
| 3,619,873 | 11/1971 | Perkins | 425/262 |
| 3,966,389 | 6/1976 | Shubert | 425/262 |
| 4,067,680 | 1/1978 | Perkins | 425/262 |

*Primary Examiner*—Lester L. Lee

*Attorney, Agent, or Firm*—Christel, Bean & Linihan

[57] ABSTRACT

The present disclosure relates to a so-called drag trowel which is drawn through a pipe or the like to trowel a layer of mortar or other plastic lining material therein. The trowel is frustoconical, having a small leading end of relatively fixed diameter and a larger trailing end which is adapted to expand and contract in the direction of its diameter. The present disclosure provides a novel means within the trowel for exerting a resilient expansive force thereagainst in a circumferential direction fairly close to the large end of the trowel. The expansion means comprises resilient means extending lengthwise along the inner surfaces of the trowel with means for translating the force of the resilient means to a circumferential expansive force and with means for adjusting the effective force of the resilient means.

3 Claims, 4 Drawing Figures

TROWEL FOR PIPE LINING MATERIAL

BACKGROUND OF THE INVENTION

This invention relates to pipe lining apparatus wherein a protective coating of mortar or similar material in plastic condition is applied to the interior of a pipe or other cylindrical conduit and more particularly to a troweling means for smoothing the surface of such an interior coating directly after the same has been applied to or deposited against the interior wall of a pipe. Such troweling means are generally known in the art as drag trowels and are usually frustoconical, having small leading ends and larger trailing ends. The trowels are commonly connected to the rear ends of mortar applying machines to be drawn through the pipe thereby.

The prior art contains a number of examples of sheet metal frustoconical trowels for the general purpose of smoothing an interior mortar coating by pulling the trowel through a pipe wherein such mortar has been applied to the interior surface of the pipe. The trowel is drawn through the pipe with its small end first and the large or trailing end of the trowel which performs the mortar-smoothing function is necessarily resilient and must be readily expansible and contractable in a diametral direction while still generally retaining its circular form or tending to maintain such form even though local conditions may cause the large troweling end of the trowel to assume somewhat elliptical or other distorted forms temporarily.

Since trowels of this type are drawn through a pipe under conditions where the operation of the trowel cannot be observed during its functional periods, the necessity for safe, accurate and foolproof operation and self-adjustment for various physical conditions which are encountered by the trowel in its passage through a pipe is of great importance.

The present invention is concerned particularly with the means for applying resilient expansive forces to the large trailing end portions of frustoconical trowels of this general type. A considerable variety of trowel expanding arrangements are found in the prior art. Representative examples will be found in Perkins U.S. Pat. Nos. 2,924,867 and 3,188,710 and Ruegsegger U.S. Pat. Nos. 3,257,698 and 3,257,699. Another example of a trowel expansion means of the present invention is found in Barton U.S. Pat. No. 3,263,296 wherein an expansion coil spring is disposed within the large end of the trowel at and extending across each overlap of the trowel plate or plates for applying expansive forces thereto. Such a coil spring is, by its nature, not readily adjustable as to the expansive force which it exerts and, furthermore, is apt to become fouled by dried mortar so that its operation is not uniform and reliable and may in certain cases be more or less entirely useless by reason of the presence of dried mortar in the coils of the spring or other operating parts.

It is believed that the closest approaches in the prior art are found in Perkins U.S. Pat. No. 3,188,710 and Barton U.S. Pat. No. 3,368,253 and the Ruegsegger patents enumerated above.

SUMMARY OF THE INVENTION

In the trowel expanding arrangement of the present invention, each overlapping pair of pivoted trowel plates is provided with an extension coil spring which extends lengthwise along the inner surface of the trowel plates. This permits the use of coil springs of substantial length and a wide range of expanding forces. Means are provided for readily adjusting the effective lengths of the springs.

Speaking generally, the trailing ends of the coil springs are connected to means for translating the lengthwise pull of each coil spring to a resilient trowel plate expanding force in a direction which is circumferential with respect to the trailing end of the trowel so that the coil springs exert a resilient trowel diameter expanding force.

DESCRIPTION OF THE ILLUSTRATIVE EMBODIMENT

Figure 1:
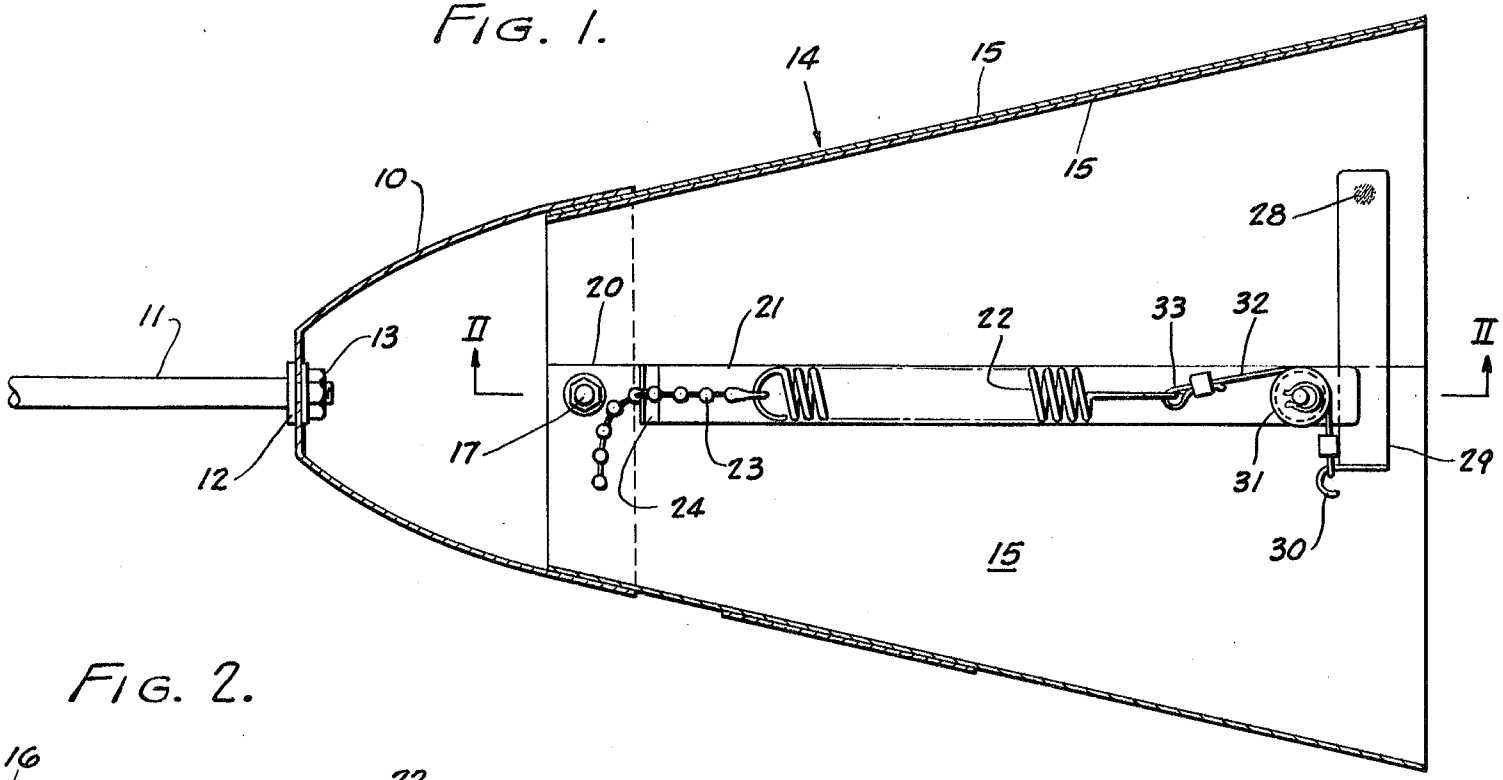
FIG. 1 is a longitudinal cross-sectional view through one form of the trowel of the present invention.
Figure 2:
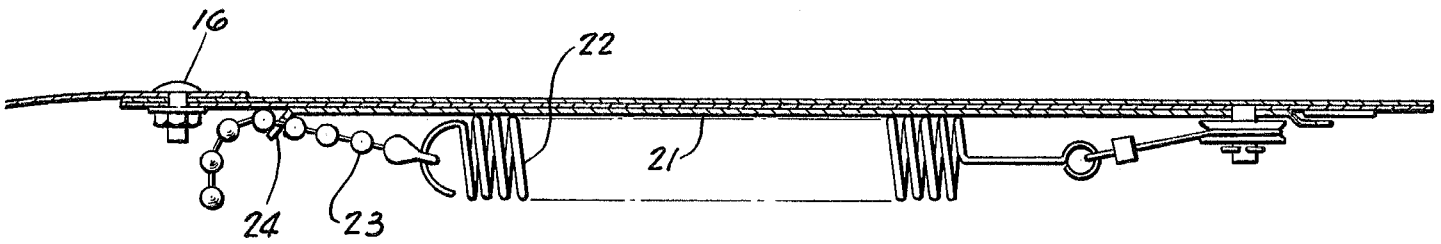
FIG. 2 is a fragmentary longitudinal cross-sectional view taken approximately on the line II—II of FIG. 1.

FIG. 1 shows a frustoconical pipelining trowel of the general type here under consideration. In FIG. 1 the numeral 10 designates generally a cup-shaped support member which has rotatedly connected thereto along its axis of generation a rod 11 which connects the same with suitable traction means for drawing the trowel through a pipe or conduit to trowel material which has been deposited on the inner surface thereof. The traction rod 11 may have a collar 12 fixed thereto and a washer 13 and nut 14 cooperate to provide a rotatable connection between rod 11 and cup-shaped support member 10.

In the present instance the trowel body proper is designated generally by the numeral 14 and may be made up of various numbers of individual trowel plates. In the present instance the numeral 15 designates three individual trowel plates which overlap along longitudinal lateral portions thereof to form the frustoconical trowel body 10. The overlapping edges of the trowel plates 13 fit within the cup-shaped member 10 at their small ends and a screw member 16 extends inwardly through the cup-shaped member 10, and through the overlapping adjacent portions of each pair of trowel plates. A nut 17 completes each pivoted connection between adjacent trowel plates and also retains the pivoted ends of the trowel plates in the cup-shaped support member 10.

An important feature of novelty of the present trowel construction resides in the means which is provided for resiliently urging the trailing ends of the trowel plates radially outwardly by pivoted movement of the trowel plates on the screws 16. To provide this resilient expansive force the following means are provided in association with each adjacent pair of overlapping trowel plates.

Figure 3:
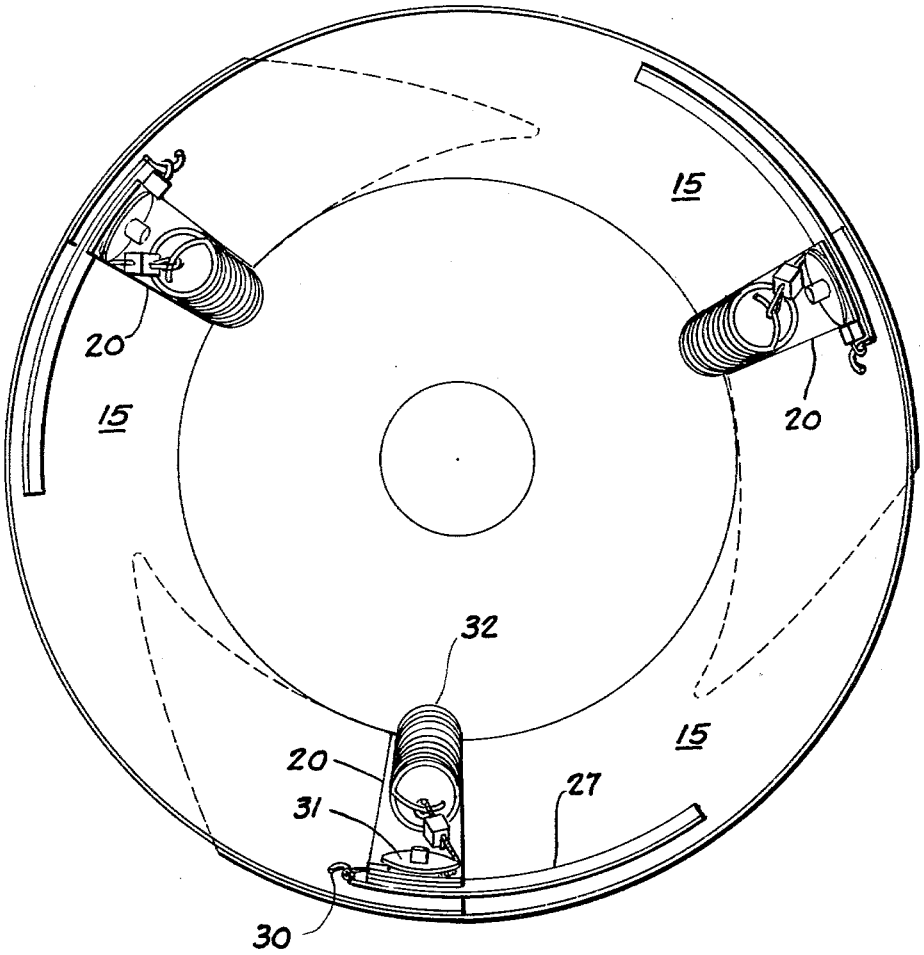
FIG. 3 is an end elevational view of the trowel of FIGS. 1 and 2 viewed from the large or trailing end thereof and illustrating one form of the trowel expanding means of the present invention.
Figure 4:
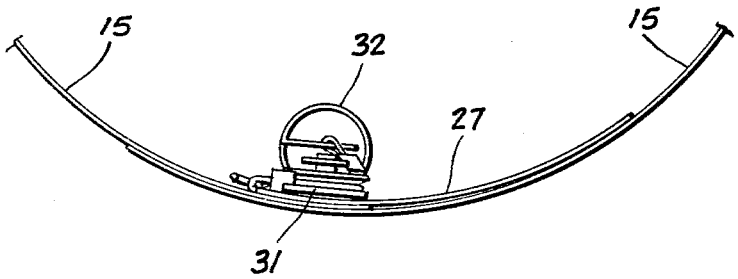
FIG. 4 is a fragmentary view generally similar to the lower portion of FIG. 3 but viewed in a direction coaxial with the coil spring shown in FIG. 4.

The portion of each trowel plate which extends within an adjacent trowel plate has an edge portion 20 which extends in a line co-planor with the axis of the trowel as is illustrated in FIG. 3. A metal strip is fixed to the inner surface of each trowel plate 15 along the edge portion 20 thereof and an extension coil spring 22 lies along the inner surface of each strip 21.

The end of each coil spring 22 toward the leading end of the trowel is, in the present instance, connected with a flexible bead chain 23. The adjacent end of strip 21 is bent outwardly from the trowel plate to which it is attached as at 24 and notched at its end to engage between adjacent beads of chain 23. This provides ready means for adjusting the effective length of each spring 22 by hooking selected portions of the chain into the notch of the flange at the leading end of strip 21.

The opposite end of each spring 22, that is the trailing end, is arranged to apply a resilient expansive force across each of the overlapping trailing portions of the trowel plates 15 in a manner which will now be described. Referring more particularly to FIG. 1 a metal strip 27 is fixed to the outer of each pair of overlapping trowel portions 15 as at 28 and the other end of each strip 27 extends slidably over the inner of the pair of overlapping trowel portions as at 29. This end of each plate 27 is provided with a hook formation 30.

A pulley 31 is rotatably mounted at the inner side of each strip 21 and a flexible cable 32 is connected at one end to each spring 22 as at 33, extends over pulley 31, and is connected at its opposite end to hook 30 of strip 27. Thus the spring force pulls the attached end of cable 32 to the left as viewed in FIG. 1 and exerts a resilient upward force on hook 30 as viewed in FIG. 1. This exerts a resilient spreading force on each pair of overlapping trowel plate portions. As shown in the drawings the trowel is in its fully expanded condition.

A preferred embodiment of this invention having been hereinabove described and illustrated in the drawings, it is to be understood that numerous modifications thereof can be made without departing from the broad spirit and scope of this invention as defined in the appended claims.

I claim:

1. A trowel for smoothing a layer of plastic material against the interior of a generally cylindrical conduit, said trowel comprising one or more longitudinally extending plates forming a frustoconical trowel body having overlapping portions corresponding to the number of trowel plates, connecting means at the small end of the trowel body constraining the same to a relatively fixed diameter at such small end but permitting diametral expansion and contraction of the trowel body at the large end by relative intersliding movement of said overlapping portions, and means at the interior of the trowel body for applying a resilient expanding force adjacent to the large end thereof, said means comprising a coil spring connected to the interior of said trowel adjacent to the leading end thereof and extending rearwardly therein along the edge portion of the inner one of each pair of overlapping trowel plates, motion translation means comprising a pulley carried by said inner trowel plate and a cable connecting with the rear end of said coil spring and extending laterally in the trowel means about said pulley and across the overlap of said trowel plates and into connection with the inner surface of the outer one of said pair of overlapping plates, whereby the tension of said spring acting through said motion translation means exerts a diameterincreasing force on said outer trowel plate.

2. A trowel according to claim 1 wherein each leading end coil spring connection is adjustable along said trowel to adjust the expansive force of said spring.

3. A trowel according to claim 1 having means attached to the inner surface of said outer trowel plate and projecting circumferentially over and in sliding relation with said inner trowel plate, said flexible cable being attached to the overlying portion of said means whereby the force of said spring urges said trowel plates in a diameter-increasing direction.

* * * * *